US007062895B1

(12) United States Patent
Sperie

(10) Patent No.: US 7,062,895 B1
(45) Date of Patent: Jun. 20, 2006

(54) METHOD OF TRAINING EQUINE ATHLETES AND APPARATUS THEREFOR

(76) Inventor: Cheryl L. Sperie, 1102 Nesbitt Rd., Northfield, OH (US) 44067-1702

( * ) Notice: Subject to any disclaimer, the term of this patent is extended or adjusted under 35 U.S.C. 154(b) by 420 days.

(21) Appl. No.: 10/222,665

(22) Filed: Aug. 16, 2002

Related U.S. Application Data

(60) Provisional application No. 60/313,092, filed on Aug. 18, 2001.

(51) Int. Cl.
*B68B 1/00* (2006.01)

(52) U.S. Cl. ..... 54/71; 119/712

(58) Field of Classification Search ..... 119/712, 119/702; 54/71; 482/8–9
See application file for complete search history.

(56) References Cited

U.S. PATENT DOCUMENTS 3,543,725 A * 12/1970 Kirkpatrick et al. ..... 119/702
4,566,461 A * 1/1986 Lubell et al. ..... 600/481
5,325,340 A * 6/1994 Ramsey ..... 368/3
5,451,922 A * 9/1995 Hamilton ..... 340/309.16
6,013,007 A * 1/2000 Root et al. ..... 482/8
6,463,385 B1 * 10/2002 Fry ..... 701/213
6,551,252 B1 * 4/2003 Sackner et al. ..... 600/536

* cited by examiner

*Primary Examiner*—Teri Pham Luu
*Assistant Examiner*—Kimberly S. Smith
(74) *Attorney, Agent, or Firm*—Donald A. Bergquist

(57) ABSTRACT

An electronic programmable timing instrument for real-time monitoring of an equine athlete's training and conditioning regimen for developing optimum racing potential is provided wherein the instruments aids an operator primarily to set, monitor, and control the equine athlete's distance and speed. Secondarily, the apparatus can monitor and evaluate physiological parameters that are used to assess physical stress on the animal in real time and includes security parameters for protecting proprietary collected data. This instrument makes possible a new method for training equine athletes and for tracking their development and potential problems therewith.

11 Claims, 4 Drawing Sheets

METHOD OF TRAINING EQUINE ATHLETES AND APPARATUS THEREFOR

This application claims the benefit of Provisional application Ser. No. 60/313,092, filed Aug. 18, 2001.

INTRODUCTION

This invention relates to the training of athletes, particularly the training of equine athletes that participate in timed performance events that include all types of racing. It provides a novel method to plan, instruct, record, evaluate, and store a variety of data relating to the training exercises.

Advances in athlete timing instrumentation during the past twenty years have been fueled by progress in the design and construction of electronic components and systems and complementary software. The equine industry has not yet been able to take full advantage of the advances in electronics in planning, instructing, recording, and evaluating the day-to-day training activities through which they put their animals.

The equine industry has a wide variety of athletic events for all types of equine athletes. These events require that the equine athlete be under the guidance and control of a trainer and a driver or rider. An individual may combine more than one of several specific designations.

As used herein, "training" is used to indicate the complex procedure on not only training a horse in terms of having it follow directions or conditioned behaviors (as a trained seal) and having it become accustomed to surrounding racetrack geometry, topography, parameters, and equipment, but the term also includes physical conditioning to develop muscles as well "muscle memory" (a term used to define how athletes and performance artists, such as pianists, train to be able to perform certain tasks almost instinctively without really thinking about them). A trainer, then is not merely one who teaches behaviors, but one also concerned with physical development of the athlete.

As used herein, a "trainer" is that individual performing the function of evaluating the condition and performance of the equine athlete, planning a training sequence for the equine athlete, and attempting to ensure that the planned training sequence is implemented for the equine athlete. The individual who is an owner, driver, or rider of the equine athlete could be the same individual who is the trainer under this definition.

As used herein, a "handler" is that individual performing the function of direct hands-on control of the equine athlete. The handler operates under the supervision of the trainer. The handler may be a driver, rider, exercise boy, or some other person who functions in the capacity of directly controlling the equine athlete. The handler could be the same person who is the trainer or the owner.

Whereas the operating of the present invention will be described in terms of the functional responsibilities of a trainer and a handler, it must be understood that any function of the trainer may be delegated to a handler or another assistant. Similarly, any function of the handler may be assumed by the trainer. The distinguishing between trainer and handler in this description is for the purpose of showing that a hierarchy may exist in which controls are in place to monitor and record the exercise activity of the equine athlete, to monitor and record the compliance of the handler with the instructions from the trainer as to correctly executing the trainer's prescribed training sequence, and the secure archiving of the collected data to document the training history of the equine athlete, including certain physiological health parameters. These collected data are considered to be highly confidential proprietary data for which security is desired.

Athletic events for equine athletes includes all types of equine racing, such as harness, thoroughbred, quarter horse, and Arabian racing and a variety of other types of competitive athletic events. The variety of other equine athletic events include competitions of cross-country 3-day eventing, endurance riding competitions, trail riding competitions, game events, and other types of driving competitions. All of these are timed events, and the participants do not have an effective or accurate timing instrument to use in monitoring the conditioning of the equine athlete, nor to accurately monitor health parameters.

An equine athlete is an equine that is specifically bred, purchased, trained, and conditioned for use in competitive events. These events are time-based activities (i.e., the equine athlete that completes the event in the shortest time period is the winner) in which the participants compete for money, prizes, trophies, or breeding revenues.

Equine breeding farms use selective breeding programs based on specific bloodlines (those crosses that have produced speed and endurance) and equine conformation to continually upgrade toward what the industry or the individual breeder considers to be the ideal equine athlete. These equines are bred for the aforementioned attributes within each breed to produce what the breeder believes to be the best candidate for the competitive events available to each breed.

The timing instruments used as aids in training and conditioning human athletes are, at best, adequately accurate. These timing instruments incorporate various designs and programs. The timing instruments aid the individual athlete or group of athletes to achieve desired athletic conditioning programs for times and distances. The timing instruments in use are mechanical and electronic watches (electronic timers with automatic sensing of start time and stop time), heart rate monitors, bicycle computers, electric/electronic exercising equipment, altimeters, depth gauges, compasses, etc. The more sophisticated of these timing instruments require that the operator understands and memorizes specialized program codes. The operator can then obtain the results of the conditioning exercise by using manual operations, but in most instances without hard-copy results.

None of the above-mentioned timing instruments are directly applicable or adaptable for the needs of the equine athlete. The equine industry primarily uses a mechanical, manually-operated, or low-level electronic, hand-held stopwatch. Actual time and true distance traveled are not accurately measured and reliable hard-copy results are totally lacking.

A trainer or handler has to consider all the many different aspects and circumstances involved in conditioning an equine athlete properly. When one considers that the situation involves a human attempting to control and direct a large animal that cannot provide intelligible responses, the variables of a conditioning program for an equine athlete takes on many disadvantages for the trainer's or handler's obtaining accurate results in measuring time and distances. There are no accurate and reliable health parameter-monitoring and recording appliances available for use within the actual training program as the training programs are in progress.

Using the hand-held stopwatch has long been the mainstay in conditioning the equine athlete within all areas of competitive timed events in the equine industry. Where timing is primary, improved timing equipment is needed; the present invention will address this need with updated technological advances to provide the optimum training and conditioning tool for the equine industry and it will include important health-related parameters to monitor, indicate, and record exercise stress levels.

BACKGROUND

The training and conditioning of any athlete, human or animal, is a complex process. For a trainer to achieve optimum athletic abilities from an animal is certainly the more difficult. To date, in the equine industry, technologically up-to-date input addressing the need for complementary training and conditioning aids, particularly in the area of timing and health stress factors for use by the trainer or handler, has been lacking.

The trainer has many complex variables to address in training and conditioning the equine athlete. These variables include the animal's age, attitude, level of intelligence, adaptability for the specific athletic event, conformational positives and negatives, size, weight, health, and the prior and present level of actual training plus many other factors. The trainer's or handler's level of expertise and experience must be incorporated into the conceived training techniques, along with health stress levels, and the safety of each individual equine athlete being trained and conditioned.

Communication between the trainer or handler and the equine athlete is limited. The animal cannot express, in conventional terms, whether the level of training is adequate or inadequate. The equine athlete can only communicate response by body language, by unacceptable or acceptable behavior, or by observable health problems. Such communication indicates to the trainer or handler that something is not applicable nor adaptable in what is being asked or required of the equine athlete within the training program at that level for the distance and speed being requested. This communication response of the equine athlete becomes evident in all the different areas and levels of equine training.

All trainers conceive and construct specific conditioning schedules for each individual equine athlete. The schedules are subject to change if, when, and where change is needed for progressive results.

A trainer or handler must also cope with changing conditions, both natural and man-made. These changes may be weather conditions, terrain surface, uncooperativness of the equine due to poor previous training and conditioning, the inexperience of young stock, and the constant interaction with other handlers and their equine athletes, particularly in the racing and competitive training area or facility.

It will be a benefit to everyone, including the equine athlete, involved in the training process to have accurate hard-copy results of each training and conditioning exercise. This will allow for immediate assessment of whether over- or under-training and conditioning is occurring. The added benefit of health indicators in the hard-copy record will be of immense help to the trainer so immediate changes can be made in the training program before an irreversible injury to the athlete would occur. Injuries to equine athletes can result in the total loss of the owner's investment in the athlete, an outcome that is to be avoided.

Most race training and conditioning facilities have designated markers of and at ⅛-, ¼-, ½-, ¾-, 1-mile, and up to 1-½-mile distances or more. Other equine competitive events have markers that are particular to the event being conducted. Generally, equine athletes are trained in progressive speed and distance increments to reach their maximum potential. A handler must be able to maintain control of the animal, judge speed and distance, and avoid others, while keeping safety and health concerns primary for the equine athlete, themselves, and other participants.

It should be obvious that it is impossible for the handler to achieve real-time measurement with any significant degree of accuracy under such conditions as have been previously described. It is also difficult, at best, for the trainer to observe and record accurate time and distance measurements from a stationary position at a distance from the moving equine athlete. Operating and observing output from a hand-held stopwatch, and judging precise position relative to distance markers is problematic. Indicators of the actual time and distance traveled are approximate in such an environment using the industry standard method of the hand-held stopwatch or variations thereof.

The apparatus of the present invention will be seen to provide the trainer or handler with accurate time and true distance measurements along with health maintenance indicators in both a visual display and a hard-copy format. The invention will provide, for the first time, a reliable and accurate process and apparatus for collecting and preserving increment and overall elapsed times, along with the actual distance traveled by the equine athlete. Also for the first time, physiological parameters used to assess physical stress will provide humane guidelines for the equine athlete and-for the trainer or handler-technological apparatus by which these factors can be observed, collected, and recorded.

DETAILED DESCRIPTION OF THE INVENTION

This invention will be best understood by referring to the attached drawings, wherein various parts are identified by number; those numbers are consistent throughout the set of drawings.

Figure 1:
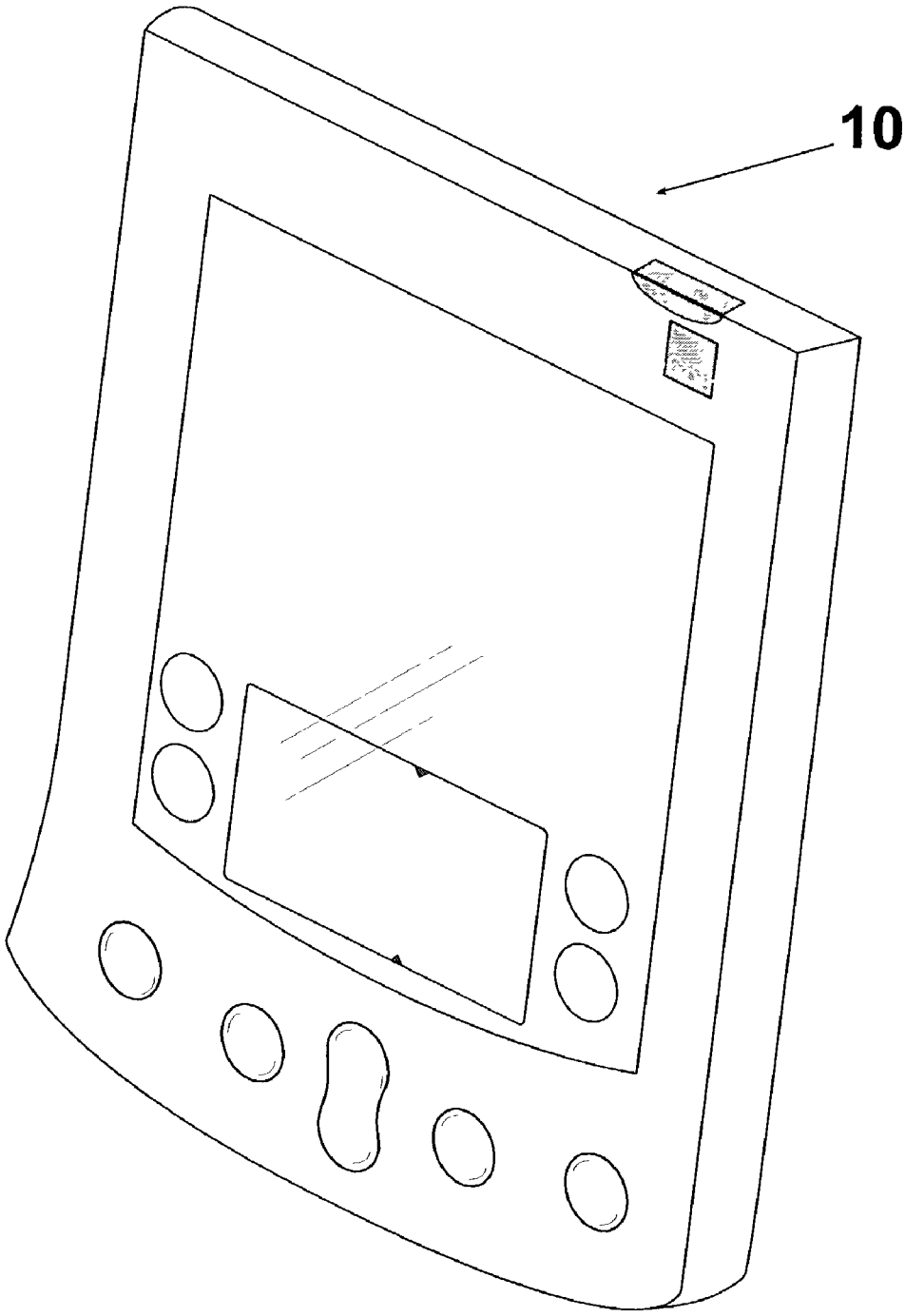
FIG. 1 illustrates a computer that can be used as a docking unit in the present invention.
Figure 2:
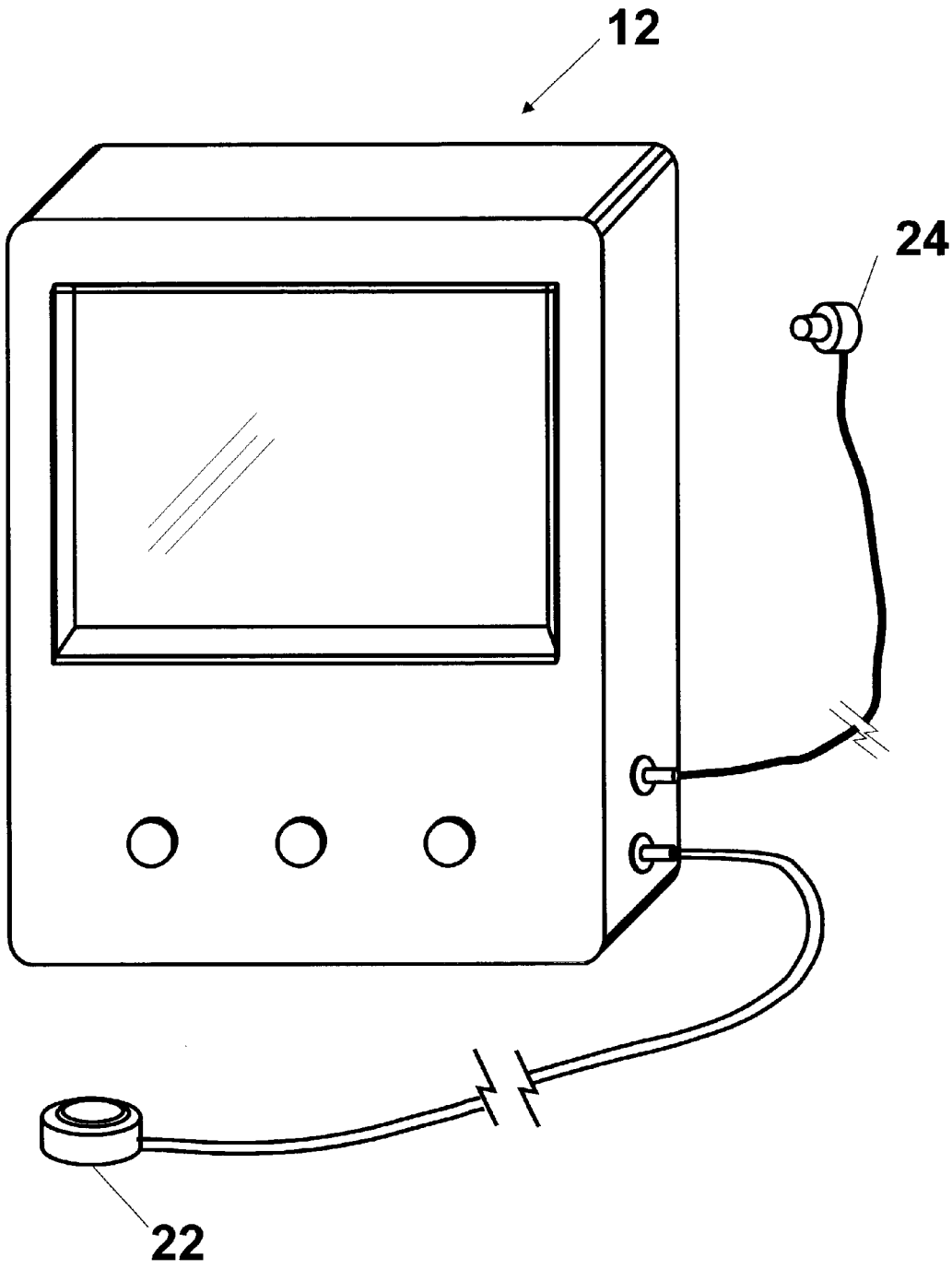
FIG. 2 illustrates a computer that can be used as a monitor unit in the present invention.

The apparatus comprises two distinct electronic units, a docking unit 10 as shown in FIG. 1 and monitor unit 12 as shown in FIG. 2. These two units are used in combination as one unit when coupled, thereby to achieve programming, data storage, record keeping, and other functions that will become apparent for data collection and training and conditioning sequence display. The separate monitor unit 12 is associated with the equine athlete in that it travels on or with the athlete.

In combination, the monitor unit 12 and the docking unit 10 are used as one unit. As used herein, various forms of the infinitive "to couple" should be interpreted as, to link, by any means by which an electronic signal carrying data may exist between the docking unit and the monitor unit. Such a link may comprise hard-wired connections, or electromagnetic waves. The lines connecting the various elements in FIG. 3 indicate these links or coupling lines, which are all capable of alternatively being connected and disconnected. These linking means are well known in the electronics industry. Although the concept of the apparatus and its specific software program does not change, there are two basic models. One model is used for driving events such as harness racing and other types of driving competitions or races. Another model includes all the same features, but with adaptations specifically tailored for riding saddles used on equines for riding competitions such as thoroughbred racing, other breed-type racing, and other types of equine competitive races or games and events where a saddle of any type would be needed.

The conceptual design of the instrument and its specific software program does not change with adaptation to the user's model of choice or need as for equipment use. The specifically-designed software programs are to be adaptable for all international use as to measurement of distance(s), language, visual and audio display where and whenever needed, such changes can obviously be incorporated.

The function of the docking unit 10 may be filled by a full-function computer, which includes a lap-top or a palm-held computer as illustrated in FIG. 1, including means for alphanumeric input, means for activating special functions, a read and record unit for one or more removable data storage media (e.g., floppy disks, CD Discs, and PCMCIA cards or other such devices), permanently-mounted data storage media (such as a hard-disk drive or equivalent solid-state memory chips), appropriate input and output connections, and a compatible operating system such as Windows or other such operating system, visual or audio operating directives along with the capacity for hard-copy printout.

The docking unit 10 is to be coupled with the second unit, the monitor unit 12, for the programming and certain operations involving the monitor unit. The monitor unit 12 is specifically designed to receive input from various transducers associated with the equine athlete, collect specific data, including physiological health data, collect and integrate specific time and distance measurements with a smart adjustment (e.g., calibration), store all collected data, and later transfer that data back to the docking unit 10 when coupled therewith.

The monitor unit 12 is specifically configured for use with a desired workout sequence that is transferred from the docking unit 10 while the two units are coupled. When not coupled, the monitor unit 12 can receive limited input from the handler, receive input from a variety of sensors, collect and store specific data pertinent to the selected training sequence, including health parameters, while making—in real time for real-time feedback—any required calibrated adjustments, compare the collected data with the prescribed training sequence, and deliver audio and visual output data to the handler and later to transfer its collected and stored data back to the docking unit 10, when again coupled therewith.

The monitor unit includes the capability for both audible and visible display output. In one embodiment, all output is via an audio output device, preferably an earphone or earpiece. Input to the monitor unit is preferably by hard-wired connection to the docking unit, but an infra-red link or other electromagnetic wave linkage is also possible, as all are known in the field of computer technology. In embodiments having a visual display, the visual display can also be an input means, although the monitor unit is programmed to receive only limited input other than from the docking unit. Small-screen displays are now quite common wherein the screen is a touch-sensitive screen and can present an array of alphanumeric characters, each of which can be input by touching the screen, usually with a stylus or other implement, including a finger or fingernail. Also, the monitor unit has at least an on-off switch and a means for starting and stopping the running of its stored program for instructional feedback to the handler based upon input from the various sensors. The means for starting and stopping is preferably a single push-button switch, which is conveniently located for the handler to tap with a hand or a foot. Other potential means would include a voice-operated start-stop means and even a remote-control start switch operated by the trainer from a distance, though the latter is thought to be the least desirable option. The programming of the monitor unit provides for false starts of the training session by sensing a second pressing of the start switch after a period of time has elapsed that is much too short a period to complete a significant workout or for any of the planned exercise program to be executed. As an alternative, this response of the monitor unit may better be prompted by a rather rapid double clicking of the start button; double clicking is a method often used for input to computer systems. Whereas all data are recorded, even during such false starts, the trainer will be aware of false starts and the total distance the equestrian athlete travels when he reviews the stored data. Starting the program after one or more false starts runs the program exactly as planned and continues to prompt the handler normally throughout the planned exercise program.

The monitor unit 12 shown in FIG. 2 is designed to be used in driving events; in harness racing it may be installed on vehicles designated as a jog bike or a race bike, and in other events, it may be installed on all other types of driving apparatus that are pulled by equines in a timed event, such as carriages, coaches, carts, and other various wheeled vehicles. The monitor unit can be modified for use with a race saddle or an English or western saddle when used in competitive events that require such equipment. In one embodiment, the monitor unit 12 would be worn by the handler in any convenient location on his body and all real-time feedback to the handler would be audible information delivered through an earphone 24 or comparable audio device. Communication links to any wheel sensors or athlete physical monitors could then be radio links or hard-wired links by flexible cables.

Figure 3:
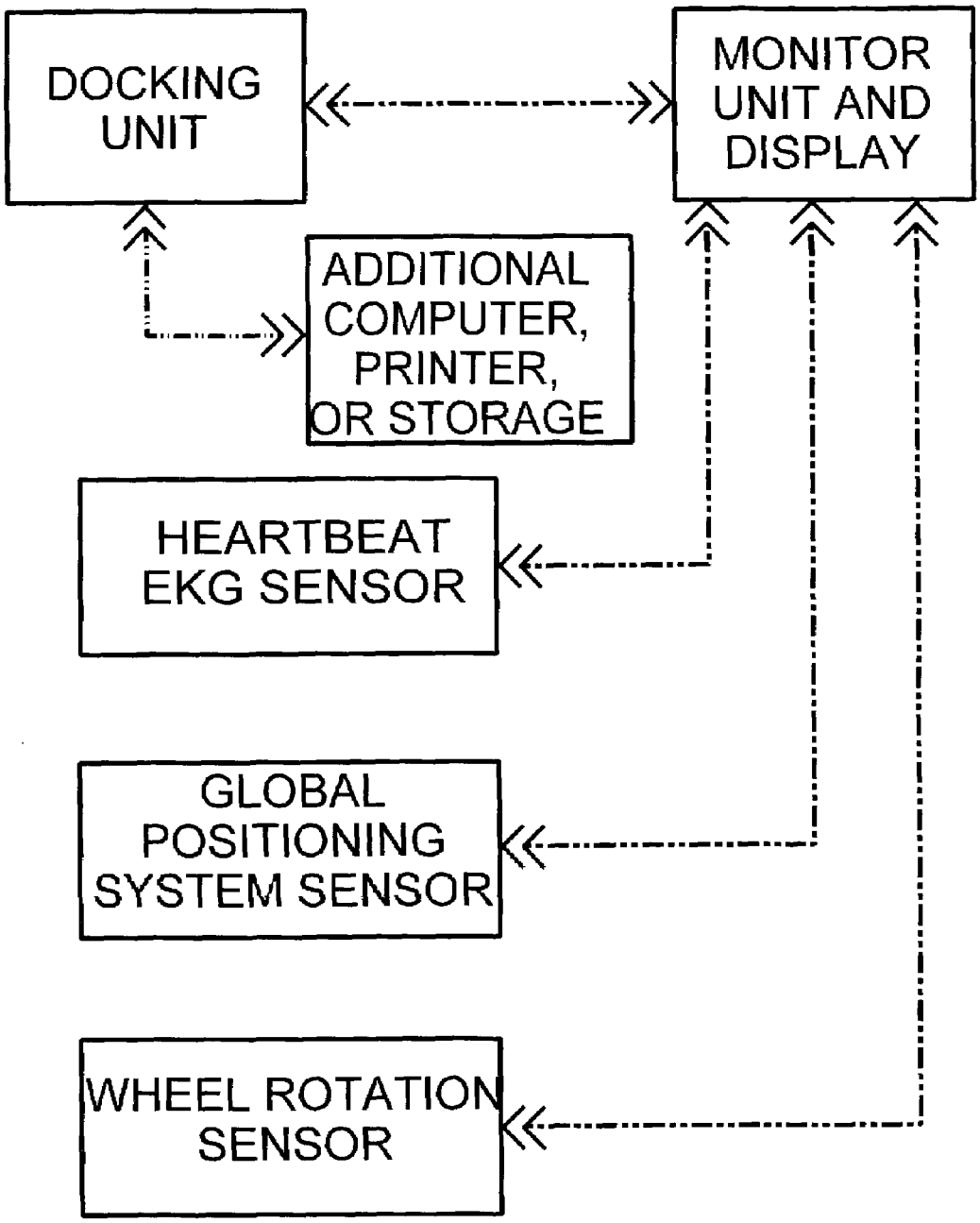
FIG. 3 illustrates the coupling of the monitor unit with the docking unit and external sensors as practiced in the present invention.

A schematic concept of the cooperative workings of the docking unit and the monitor unit is shown if FIG. 3. In addition to coupling with the docking unit, the monitor unit is adapted to be coupled to sensors that are used to monitor distances, as by a wheel rotation sensor or a global positioning system (GPS) sensor, and to sensors that monitor health parameters of the equine athlete. In the case shown in FIG. 3, a heartbeat rate, and/or electrocardiogram (HRM/EKG) sensor is indicated.

It should be noted that when we here speak of a global positioning system sensor, we appreciate that such sensors may operate from signals employing Earth-orbiting satellites or they may operate from signals employing ground-based signal sources, even from towers used for providing cellular telephone service. It would also be reasonable to expect a local track, exercise facility, or even the trainer may install a ground-based positioning system, either permanently or temporarily, to achieve extremely high precision in defining the position and motion of a particular equine athlete. These types of sensors could be used with either driving or riding equine competitions.

Collected data from the monitor unit being used in any capacity and with any type of competitive event described herein can later be transferred to the docking unit 10 for storage in memory and printout of hard-copy data. One could also generate archival or other output directly from the monitor unit 12 in one or more archival forms including printed or recorded output.

Data collected by the monitor unit 12 and transferred back to the docking unit 10 may then also (or even alternatively) be transferred to other computing or storage devices by standard means, including infra-red data link, wireless data link, microwave data link (including satellite transmission), by modem over a telephone line, or by hard-wired cable interconnecting to the other equipment. The choice of transfer may depend upon the degree of security the user believes the value of the data commands, or upon the user's choice due to time, terrain, or the natural elements involved.

Here we will discuss in greater detail the programming and transferring of information between the docking unit and the monitor unit.

When the docking unit and the monitor unit are coupled as stated herein, the two units are powered up by the individual "ON" switch located on each unit. Upon activation, the microprocessor runs a diagnostic routine to verify that the units are operating properly.

Specific peripheral areas will be checked and any indication of a malfunction will be indicated to the trainer by the audio or visual operational directives, (A/VOD) with a display of visual icon indicators, or an audio command, or both.

Audio or visual operational directives are heard and or displayed continuously throughout the entire operation of the device's activation on both the docking unit during its programming and the monitor unit during its operating.

The trainer and the handler may individually select either the audio, the visual, or both. The audio or visual operational directives may be activated or inactivated separately in either unit as the operator desires. Whenever the audio or visual operational directives are re-activated after having been run in an inactive mode, the audio or visual operational directives resume at the then-current programming step.

After the specific software program has gone through the initializing system check, any of the numerous functions may be performed; the order in which these functions are performed is subject to the particular need and desire of the trainer and is at his option. The order may change and it may be desired to repeat or eliminate a function as needed.

It must be understood that the docking unit can be used independently of the monitor unit to allow for advance preparation of the planned training sequence selections for downloading to the monitor unit(s) (a stable and/or a training facility may have several monitor units and fewer docking units) at the time deemed appropriate by the trainer. The docking unit can store individual training sequences for multiple monitor units and is limited only by the amount of memory available in the docking unit.

The specific software program is set up so that when the monitor unit's random-access memory has previously-stored collected data exceeding a predetermined threshold (such that total random access memory space may soon be insufficient to reliably hold more data), the unit will automatically alert the trainer upon startup that collected data from a previous training sequence is ready to be downloaded and, indeed, must be downloaded. This alert will be given to the trainer by the audio or visual operational directives. The downloading would begin automatically or when requested to do so, and be transferred to the docking unit by the monitor unit; when the downloading is completed, the audio or visual operational directives would alert the trainer that a new training sequence could be now entered.

This downloading is done while the two units are coupled. The monitor unit's memory is then ready to accept new training sequence selection(s) and to continue to collect and store all input and related data. The memory of the monitor unit is large enough to accept several new training sequence selections and subsequent collected data are limited only by the amount of storage available in the monitor unit.

The data collected from the monitor unit after it is transferred to the docking unit can then be downloaded to other separate memory areas of choice when the trainer so desires. The docking unit has enough memory to retain downloaded files and create new training sequence files (stored until data are transferred back after program completion). All or partial files can be transferred to a printer, a PC hard disk, a floppy disk, a CD disc, or a PCMCIA card, or other devices for visual review or hard-copy printout when wanted.

Once the monitor unit has successfully transferred to the docking unit the data it had collected and stored, the monitor unit automatically clears its memory of all collected data.

A heart rate sensor (HRM) or an electrocardiogram (EKG) sensor or both are useful for monitoring and evaluating physiological parameters of the equine athlete and to assess physical stress in real time. This is a desirable adjunct to this invention. It is foreseen that a heart rate sensor, an EKG sensor, or both would be present in the form of tack equipment that would be mounted on the equine athlete.

Current technology allows the subcutaneous implanting of a computer chip or other electronic labeling device for horses and other animals. It is anticipated that such a device could be used in conjunction with the monitor unit of this invention to be certain that the program being run on the monitor unit was intended for the exact equine athlete with which it is being used. Also, such a subcutaneous device could be created to be used as part of a heart rate sensing system as one of the sensors for input of data to the monitor unit of this invention. And additionally, a similar chip can be linked by a global positioning system employing a downlink to the monitor unit as part of a system for measuring distance traveled.

It is foreseen that the most desirable means of transmitting the output of a heart rate or EKG sensor to the monitor unit of this invention would be by radio signal; directly wiring the two units may be feasible, but is believed to be less convenient than a radio link. Whenever a heart rate or EKG sensor is in use and functioning and the monitor unit is operational, the heart rate or EKG data are recorded and stored continuously by the monitor unit. Memory initiated by the activation of the device is always recording data of any and all activity simultaneously and continuously.

The HRM/EKG capabilities incorporate a sub-program of explicitly designed software specific to the monitor unit for this invention. The specific software program will constantly interpret signals from the sensors and give a visual display of such on the monitor unit and will record and store the data continuously while the device is operational.

The indication and recording of the HRM/EKG can be extended even when the selected programming is finished and the equine athlete is standing at rest. The HRM/EKG is pre-programmed to record the necessary heartbeats/second (total minutes HRM/EKG) for a programmed period of downtime after the end of the selected training sequence. If the trainer believes additional time for collected downtime of HRM/EKG is necessary, it can be programmed to do so from the docking unit at that time or during the initial programming sequence.

Also recorded are continuous date and time, total time, and actual total distance traveled from the time of the device becoming operational. Any and all movement of the equine athlete is collected by the wheel sensor in the case of the harness jog bike or race bike or other wheeled apparatuses. The use of a global positioning receiver (with or without an antenna) utilizing the global positioning satellite system would be the means of measurements for thoroughbred racing and for other competitive equine events, to include saddle events or as an alternative in harness racing.

The global positioning system device may be a standard type of global positioning system device or a differential global positioning system device. Other types of distance measurement devices may be appropriate, including hall effect, optical, infrared, inductive, capacitive, or others that are employed to measure time and distances. Some such devices fall under the general category of position sensing devices.

When the activation sequence determines that the systems of both units are operational, the audio or visual operational directives will proceed to inform the operator, which may be the trainer, handler, or another, that the security system requires identification of an authorized user.

Identification of an authorized user could be established by means of a personal identification number (PIN), alphanumeric password, a unique physical characteristic (e.g., fingerprint or retinal scan), voice recognition, or other means of positive identification. For convenience, the ensuing discussion will refer to a numeric PIN as a useful, non-exclusive example for providing user identification to achieve the desired security.

Acceptance of the personal identification simultaneously unlocks both units, so that selected programming may begin. Each device has been assigned a specific master code identification number with unlimited personal identifications available for assignment to specific individuals chosen by the designated security system programmer. Verification of this personal identification is performed by a sub-program specifically designed for security purposes.

The security system programmer is responsible for programming each individual personal identification into the device's security system for acceptance and storage. The security system programmer controls the master security card that carries the master code identification number of each unit manufactured for the cancellation of a personal identification number when necessary to remove authorization from an individual user.

The individual user must manually enter, via the alphanumeric keyboard, the assigned personal identification number. The audio or visual operational directive, signals acceptance or rejection of the individual's entered personal identification number. Acceptance allows for the individual to begin the program selection of choice by following the audio or visual operational directive for the specific program selection.

The acceptance of the individual's personal identification number is recorded into memory, and then one or both units indicate that the selected exercise sequence may be entered.

The exercise selection choices are shown on the screenface of the docking unit. As non-limiting examples, the program selection of "jog", "train", "race", or "no program" may be selected. Depending on the program selection, the trainer must indicate, by following the audio or visual operation directive, the specific wheel size (if wheel rotation is used to measure distance), a track position, and a trip number from the program selection's screenface selection box that is applicable to the trainer's chosen program selection. Other types of events may require different input data. Programming is to be tailored for such events.

The "no program" selection is an additional programming option for the recording of time and distance only and for an undetermined distance without target times. Total time and actual distance are still recorded and so are the HRM/EKG for the entire elapsed time and distance.

The distance of a closed-course race is generally measured around the inside lane, along the inside rail. Any athlete not running in the inside lane is traveling a greater distance around the course than one traveling in the inside lane. There are some trainers who want to train or test their equine athletes while running in a lane other than the inside lane. They ask for data that is different from that which is available from measuring only the true distance the athlete has traveled, which is made available as a principal feature of this invention. They want a corrected time for traveling the longer distance of any lane outside of the inside lane. Furthermore, they want this corrected time for not just the entire race, but they want a corrected time elapsed for passing each of the distance markers around the racetrack.

While noting that the above "correction" is highly dependent upon race track geometry, it is also noted that the correction will be accurate only if the athlete travels consistently in the selected lane. The selected lane must be used especially while traversing the turns in the race track because the turns are the main reason for a correction being necessary.

The equipment of this invention is capable of presenting such "corrected data" to the trainer and handler. A selection in the programming allows the input of the needed data to complete the calculations for such correction. The data required are geometrical features of the specific racetrack including some measure of the distance from the start to the beginning of the first turn, the length of the first turn, the length of the straightaway to the second turn, the length of the second turn, the lane position selected, and the width of a lane. The required track measurements can be easily taken by measuring with a rolling measure along the inside rail and perpendicular to the rail across the running surface.

The input data are then used to calculate the distance in the selected lane from the start to each of the various distance markers around the track, which distance is greater than the measured distance along the inside rail. The calculation using these data is trivial, so it is not presented here; it is well within the scope of a high-school geometry class. As the true distance tracking portion of the program collects data on the true distance traveled, along with the time, it will create a special time mark at the point where the calculated longer distance to each distance marker is reached. Thus, the handler and trainer can read and report the times to passing each of the distance markers, even though the athlete traveled a greater distance than the markers would indicate. It is up to the trainer to interpret these results.

Once the trainer's specific exercise sequence selection has been made and is entered, a specific screenface that corresponds with the sequence selection will appear (in both the docking unit and the monitor unit). Following the audio or visual operational directive, the trainer will now continue to enter the additional data needed for the entry. For instance, the equine athlete's name is entered using the alphabetic keyboard and target times for each lap portion are entered from the numeric keyboard. Thus, all of the selected sequence input is recorded automatically in memory and may be shown simultaneously in the specific areas within the screenface(s) of both the docking unit and the monitor unit for visual review.

Target times are selected from the numerical keyboard and entered and displayed on the lines designated for each target time entry on the screenface(s) of the docking unit and the monitor unit that are specific to each user's choice of sequence selection following the audio or visual operational directives. Planned split times are entered in minutes, seconds, and fractions of a second for the distance measurements of ⅛-, ¼-, ½-, ¾-, 1-mile to 1-½-mile distance, or other selected distance increments for the selected training sequence. All increments of distance can be measured in miles or kilometers where and when applicable.

Input errors are corrected in the manner in which users of graphic-user interfaces are accustomed or in a manner known to computer users in general.

After the desired sequence selections are made and the required data are entered through the keyboards or mouse application (or other such directive devices as a stylus, roller ball, etc.) on the docking unit, and interfaced to the coupled monitor, the specifics are stored in both the docking unit and the monitor unit. The cable connection or other link used to couple the docking unit and the monitor unit is then uncoupled. Only the monitor unit need be active while collecting data.

In the programming of multiple monitor units, when the connection cable or other is uncoupled the preprogrammed monitor units can be turned off to save battery power. In order to re-activate each individual monitor unit, the docking unit is re-coupled and the entering only of the proper personal identification is required to re-activate the monitor unit of choice (This is done for security measures so that no one else could use a particular monitor unit that has been already programmed and is waiting for the particular equine athlete in stables where multiple monitor units are available). This does not mean that the monitor unit must be re-programmed, but only opened for activation of the already-preprogrammed sequence.

After activation, the monitor unit screenface now displays the time and distance as it is measured and displayed in real time. The sequence selections and entries will not be recorded until the rider initiates the official start of the selected sequence by the automatic starter.

Once the handler has put the equine athlete in motion, it will be the handler's choice when to activate the automatic starter. The automatic starter, is merely a push button 22 operated by hand or foot, or a remote-control starting device that could be activated by means of a sensor, electronic beam, or by someone other than the handler, if such a need would occur.

For example, the foot-touch automatic starter is activated by the handler administrating a single press on the foothold of a driving apparatus to start the sequence selection of selected target times versus actual time. A double-press on the foothold, de-activates the sequence selection. This double-press action results in what is called a false start for whatever reason and stops the clock and sequence within the device. It does not erase the selected sequence, but only puts the sequence on hold. A similar method of operation would be employed for the hand automatic starter for a rider in events requiring a saddle.

The period in-between the false start and the time of re-activation of the automatic starter is a time frame referred to in the equine industry as a warm-up period. A warm-up period can occur before the actual start, or in between the false start and the re-start.

Within all of the user sequence selections is embedded a sub-program of warm-up time periods. This sub-program sequence of warm-up time periods is activated when the handler de-activates the automatic starter for a false start. The sub-program sequence also records and displays the period of time referred to as the warm-up time periods which is the time before the actual start of the selected sequence by the handler. These sub-program sequences are shown on the screenface of the monitor unit as they are happening in elapsed time only, and are recorded and stored in memory along with the total time, total distance, and the HRM/EKG readings during these warm-up time periods and will be indicated as such on the hard-copy print outs.

All collected data are maintained in memory. The period between the false start (de-activation) and the re-start (activation) is always shown on the screenface as running time versus target times. These warm-up time periods are shown on the screenface only while they are happening, but are always recorded in memory for hard-copy print out.

No memory is lost during a false start and the internal clock and sensors re-activate the original sequence selection when the automatic starter is re-activated by the handler. Also, within the warm-up time periods sub-program, is an automatic recording of any and all actual time and true distance needed by the equine athlete to prepare for the trainer's sequence, and these details are shown on the screenface during pre-warm-up periods again and not only shown on the screenface of the monitor unit, but are recorded and stored in memory for hard-copy printout. Within the hard-copy printout, this pre-warm-up period is designated as such. The specifically designed software program is written to know which of these warm-up periods are active.

The handler may re-activate the automatic starter at will after a false start or at the end of the warm-up time period. The trainer's sequence selection(s) is still shown on the screenface of the monitor unit during de-activation and during any warm-up time period and the trainer's sequence selection(s) have remained intact visually and maintained in memory.

The handler resets the sequence selection back to the start position by another single foot-touch press on the foothold when the handler is ready to start the sequence selection again.

The same method of operation would be employed for the hand-touch automatic starter for a handler in events requiring a saddle, or by the remote control starter.

The automatic starter initiates the internal clock and the sensor(s) to record and display in real time the elapsed time and true distance. These actual elapsed times and distances are tallied on the matching target time lines relative to the portion of the total distance being clocked. As each pre-scheduled distance is completed, the elapsed time and true distance are recorded and the display rolls over to begin tracking the next scheduled distance in accordance with the trainer's selected sequence for the next target time.

The elapsed time is also shown running continuously on the screenface of the monitor unit and the HRM/EKG is displayed for the handler on the screenface, indicating resting (standing), normal (walking to warm-up speeds), working (training or conditioning speed), to stressed (danger) levels of the HRM/EKG of the equine athlete during the trainer's selected sequence. All collected data are recorded in memory continuously.

A color-coded rate of speed system is initiated simultaneously by the appropriate automatic starter to aide the handler in maintaining the target times pre-set by the trainer, the display may be shown, for example, as RED meaning go slower, YELLOW meaning maintain speed, and GREEN meaning go faster. The device can be set to give an audio response to the handler instead of or along with the color-coding system as the rate of speed needed to maintain the pre-selected target times. Such audio response to the handler may best be conveyed by way of an earplug or miniature speaker worn in, on, or around the ear of the handler. Such devices are in common use with personal entertainment systems and radios.

The true distance is counted for each target time line completed. When the final target time line has completed the trainer's selected sequence selection, the total elapsed time display will stop. The total actual time elapsed, from start to finish, of the trainer's selected sequence is displayed automatically on the screenface of the monitor unit for the handler at the end of each training or conditioning session.

The monitor and docking unit must be interfaced or linked after the exercise program is executed by the handler for the transfer of data to the docking unit. Limited amounts of these data are available for viewing on the monitor unit by the handler using input prompts on the monitor unit itself, but none of the data can be altered or deleted except by connecting to the docking unit.

All collected and recorded data transferred to the docking unit are made accessible for a hard-copy print out. The user can, by choice, obtain specific types of hard-copy printout from an auxiliary printer or from a PC unit by following the audio or visual operational directives. Hard-copy printout can be retrieved for each specific individual equine athlete for a specific day, week, or month. The device will provide a visual on-screen record of each equine athlete's user's sequence selection at the end of the workout with HRM/EKG readings on the screenface of the monitor unit until the monitor unit is de-activated by the control key, which then terminates all of the programming and the screenface of the monitor unit.

Thus, it is seen that by using the apparatus herein described, a new and improved method of training equine athletes is made available to the trainer of an equine athlete. The apparatus provides the trainer with the ability to plan, execute, and monitor exercise sequences for the equine athlete with a level of precision that has never before been available to him. Recorded results present him with evidence that his instructions are being carried out exactly and that the athlete is not being overly stressed by the planned exercise sequences as they are executed. Evidence of improved physical conditioning of the equine athlete over time becomes irrefutable so that the trainer can see the effect of different training regimens, thereby to improve his methods and to improve the athletes he trains.

Figure 4:
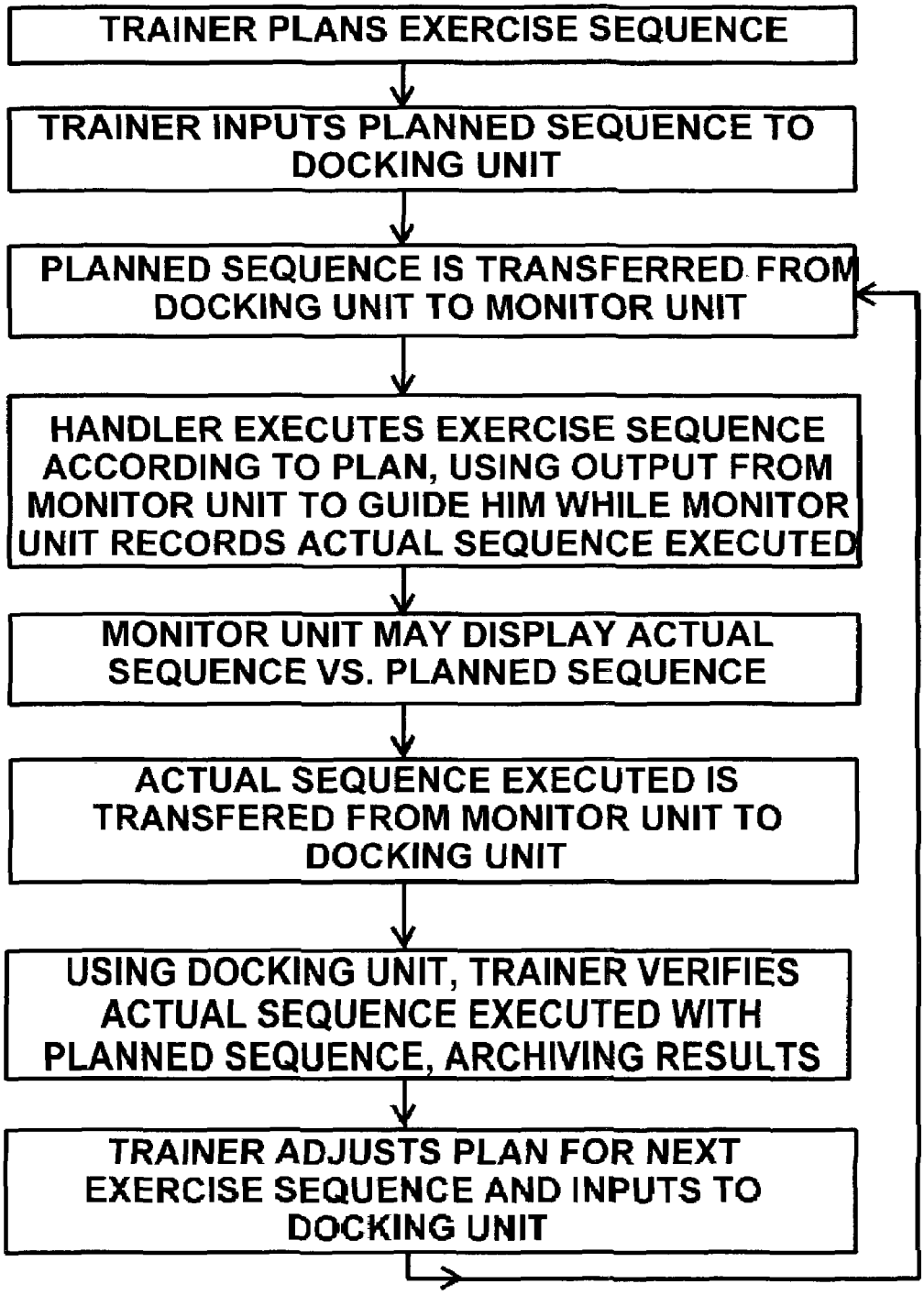
FIG. 4 illustrates the steps in the training method of the present invention.

The training and conditioning process is illustrated in FIG. 4, wherein is shown the sequence of steps, some of which are optional. The trainer's expertise and experience is brought into play in first planning an initial exercise sequence for a particular equine athlete. This exercise sequence may, from time to time, be confidential information, not to be shared with outsiders. The trainer, using the security features of the equipment, enters the planned sequence into the docking unit, which may hold at least several of such sequences for the same or different equine athletes.

At a convenient time before the exercise is to be performed, the planned sequence is transferred from the docking unit to the appropriate monitor unit for the athlete for whom it is intended. If the monitor unit is then shut down to conserve battery life, it must be re-coupled with the docking unit to initiate the already-stored program.

The handler then takes the athlete through the planned exercise sequence using output from the monitor unit to guide him. Throughout the exercise sequence, the monitor unit is not only issuing guidance to the handler, but it is recording data showing the actual sequence of the exercise as it was executed, which data are to be compared with the planned sequence. This comparison of planned versus actual performance in an incontrovertible format will ensure the trainer that the handler followed instructions and did not allow the equine athlete in his charge to slack off nor be overstressed. This feedback has not heretofore been available in a reliable form.

The comparison of planned versus actual performance may be viewed directly on the monitor unit as an option that may be made available, but for archival purposes and for more careful analysis, the actual sequence executed is transferred from the monitor unit to the docking unit. The trainer then can verify and archive the actual sequence executed and the planned sequence, archiving the results.

Given the feedback, the trainer can now modify the exercise sequence for the next outing and enter the new plan into the docking unit for immediate or later downloading to the monitor unit. This step effectively closes the loop to allow continuous improvement of the training and conditioning of the equine athlete.

No doubt there are variations in apparatus and method that will be obvious to one skilled in the art. It is intended that this application embrace any such obvious variations and its scope be limited only by the claims appended hereto.

I claim:

1. Training device for an equine athlete comprising in combination:

a. a monitor unit for use in training equine athletes to assist an equestrian handler in maintaining an equine athlete at desired pace or speed, the monitor unit comprising:

timing means for measuring elapsed time;

distance-measuring means for measuring overall distance traveled;

user-programmable memory capable of storing a plurality of pacing sets comprising at least two different intervals, each interval corresponding to selected scheduled pacing information;

additional memory means for storing data collected during an exercise routine;

electronic coupling means to couple an input device thereto for two-way data transfer;

processing means for calculating actual pace and comparing it in real time with scheduled pacing during each interval;

signal means in real-time response to said comparing to alert said handler to urge faster or to retard said equine athlete, thereby to attempt to adhere to said scheduled pacing throughout each interval wherein the monitor unit is located on an apparatus selected from the group consisting of an equine-pulled driving apparatus and an equestrian saddle; and b. a docking unit capable of receiving and electronically storing exercise scheduling input data from a trainer and transferring by way of said coupling means a portion of said input data to said coupled monitor unit that is subsequently uncoupled from said docking unit to travel with said equine athlete during an exercise routine under the control of said handler said docking unit also having electronic storage means to receive performance data from said monitor unit during a subsequent re-coupling and also having processing means for data review and analysis by said trainer.

2. The training device described in claim 1 further comprising, coupled with said monitor unit, heart-beat detecting means for monitoring and recording the heart rate of the equine athlete, with signal means in said monitor unit to warn said handler of excessively high heart rate.

3. The training device described in claim 1 further comprising, coupled with said monitor unit, electrocardiogram means for monitoring and recording the electrical activity of the heart of the equine athlete, with signal means in said monitor unit to warn said handler of dangerously abnormal heart activity.

4. The training device described in claim 1 wherein said real-time response comprises speed of travel data during short time intervals during each portion of the exercise routine.

5. The training device described in claim 4 wherein said speed of travel data are extracted from a wheel-rotation sensor on a wheel in substantially continuous contact with the Earth.

6. The training device described in claim 4 wherein said speed of travel data are extracted from a satellite-based global-positioning system.

7. The training device described in claim 4 wherein said speed of travel data are extracted from a ground-based electronic positioning system.

8. The training device described in claim 1 wherein recorded performance data stored in said monitor unit can be transferred to said docking unit when the monitor unit is re-coupled to said docking unit after said exercise routine.

9. The training device described in claim 8 wherein said performance data transferred to said docking unit may be manipulated in said docking unit including displaying, comparing, printing, and archiving.

10. The training device described in claim 6 wherein said speed of travel data extracted includes direction of travel, and the actual path taken by the equestrian athlete around a measured racetrack from which is calculated for each interval of measured track distance, the actual elapsed time had the horse traveled said measured track distance in a specific lane of travel around the racetrack.

11. The training device described in claim 7 wherein said speed of travel data extracted includes direction of travel, and the actual path taken by the equestrian athlete is calculated, therefrom to calculate for each interval of measured track distance the actual elapsed time were the horse traveling said measured track distance in a specific lane of travel around a racetrack.

* * * * *